United States Patent [19]

Gueret

[11] Patent Number: 4,812,066

[45] Date of Patent: Mar. 14, 1989

[54] DEVICE FOR APPLYING A PASTY PRODUCT, IN PARTICULAR A COSMETIC PRODUCT SUCH AS LIPSTICK AND A TUBULAR ELEMENT FOR SUCH A DEVICE

[75] Inventor: Jean Louis H. Gueret, Paris, France

[73] Assignee: L'Oreal, Paris, France

[21] Appl. No.: 220,942

[22] Filed: Jun. 27, 1988

Related U.S. Application Data

[63] Continuation of Ser. No. 874,169, May 20, 1986, abandoned.

[30] Foreign Application Priority Data

Dec. 18, 1984 [FR] France ..... 84 19335

[51] Int. Cl.[4] ..... A45D 40/06

[52] U.S. Cl. ..... 401/78; 401/86; 401/87

[58] Field of Search ..... 401/74, 77, 78, 80, 401/86, 87, 98

[56] References Cited

U.S. PATENT DOCUMENTS

| | | | |
|---|---|---|---|
| 2,442,109 | 5/1948 | Anderson . | |
| 2,545,864 | 3/1951 | Thompson et al. . | |
| 2,797,802 | 7/1957 | Hopgood . | |
| 2,840,229 | 6/1958 | Hopgood . | |
| 3,272,327 | 9/1966 | Busch | 401/78 |
| 3,850,183 | 11/1974 | Gruska | 401/78 X |

FOREIGN PATENT DOCUMENTS

| | | | |
|---|---|---|---|
| 1079810 | 12/1954 | France | 401/86 |
| 1417277 | 12/1963 | France . | |
| 1501043 | 11/1967 | France . | |
| 237724 | 8/1925 | United Kingdom | 401/87 |
| 1118889 | 7/1968 | United Kingdom | 401/78 |

*Primary Examiner*—Richard J. Apley
*Assistant Examiner*—Franklin L. Gubernick
*Attorney, Agent, or Firm*—Cushman, Darby & Cushman

[57] ABSTRACT

The device comprises: a tubular element (3) with a slide (4, 5) wherein there is slidably mounted a cup (9) intended to accommodate a stick of a product; a cylindrical shell (12) in the wall whereof provision is made for at least one helical groove capable of cooperating with the stubs (10, 11) of the cup, this shell (12) being fitted on the tubular element (3) and an external casing. The tubular element (3) with a slide is provided on its external wall towards its end remote from the outlet opening (17) with elastic stop (21) capable of bearing against the adjoining edge (22) of the cylindrical shell (12) when the latter has been fitted on the tubular element (3), the above mentioned elastic stop (21) pushing the shell (12) along a direction parallel to the axial direction against the stop (B1, 19) provided at the other end.

15 Claims, 3 Drawing Sheets

DEVICE FOR APPLYING A PASTY PRODUCT, IN PARTICULAR A COSMETIC PRODUCT SUCH AS LIPSTICK AND A TUBULAR ELEMENT FOR SUCH A DEVICE

This is a continuation of application Ser. No. 06/874,169, filed May 20, 1986, which was abandoned upon the filing hereof.

The invention relates to a device for applying a pasty product, in particular a cosmetic product such as lipstick presented in stick form, a device of the type comprising: a tubular element with a slide wherein there is slidably mounted a cup intended to accommodate the stick of the product and comprising at least one stub engaged in the slide, a cylindrical shell in whose wall provision is made for at least one helical groove, this shell being fitted on the tubular element and being retained on the latter by stop means at its two axial ends, the stub or stubs of the cup being engaged in the heilcal groove(s) of the shell and possibly an external casing, in particular a metallic one, wherein the shell is secured whilst the tubular element can turn in relation to the said shell and casing, the unit being such that when the tubular element is caused to turn in relation to the shell, the cooperation of the stub or stubs of the cup with the helix produces an axial movement of the cup and the emergence or retraction of the stick of the product according to the direction of rotation, via one outlet end of the tubular element.

Because of the variations in the dimensions of the components of this device, in particular of the tubular element and of the shell, these dimensional variations being inevitable in production, one has been induced to make provision for production tolerances leading in certain cases of assembly, to relatively large amounts of play, in particular, parallel to the axial direction, between the tubular element and the shell. The device is then relatively loose and because of the amounts of play present, the tubular element can be slightly displaced in relation to the shell; this leads to an actuation for the displacement of the stick of the pasty product which lacks precision.

Various solutions have so far been proposed to minimise this drawback but they do not give complete satisfaction.

The object of the invention is above all to provide a device for applying a pasty product of the kind defined above which would meet the various practical requirements better than hitherto and which would, in particular, no longer have the drawback referred to above or only to a lesser extent. It is, moreover, desirable that such a device should be simple to make and economical.

In accordance with the invention, a device for applying a pasty product, in particular a cosmetic product such as lipstick presented in stick form of the kind defined above, is characterised in that the tubular element with slides is provided on its external wall towards its end which is remote from the outlet end, with elastic stop means capable of bearing against the adjoining edge of the cylindrical shell and/or of the casing when these latter have been fitted on the tubular element, the above mentioned elastic stop means pushing the said shell along a direction parallel to the axial direction against the stop means provided at the other end.

The elastic stop means can comprise a boss projecting radially towards the outside provided on a flexible strip of the wall of the tubular element.

Advantageously, this flexible element is orientated transversely in relation to the axis of the tubular element.

The said flexible strip can be defined by two transverse holes provided on either side of the said strip.

Advantageously, the flexible strip is formed by one portion of the wall of the tubular element which is generally made of a plastic material.

The flexible strip is preferably orientated along the circumferential direction, orthogonally to the axis of the tubular element.

The elastic strip means are generally provided in at least two diametrically opposed points of the tubular element. The elastic stop means can be situated along the circumference at right angles in relation to two diametrically opposed sides of the tubular element.

The elastic stop means, in particular the boss, have a radial dimension which is sufficiently large to rub against the internal surface of the casing and serve as a lateral restraint.

According to another possibility, the elastic stop means can comprise an elastic component disposed between a shoulder of the said tubular element and the cylindrical shell and/or the casing.

The said component is advantageously formed by an elastic ring surrounding the tubular element.

The invention also concerns a tubular element for a device such as defined above, this tubular element being characterised in that it is provided on its external wall towards the end which is remote from the outlet end, with elastic strip means comprising in particular a boss provided on a transverse flexible strip delimited by two holes provided on either side of the strip.

Apart from the arrangements set out above, the invention consists of certain other arrangements which will be discussed in greater detail below in relation to a particular mode of embodiment described with reference to the attached drawings but which is in no way restrictive.

FIG. 1 of these drawings is a cross section along the line I—I of FIG. 2.

Finally, FIGS. 15 to 18 represent other variants of the embodiment in partial axial half cross sections.

Figure 1:
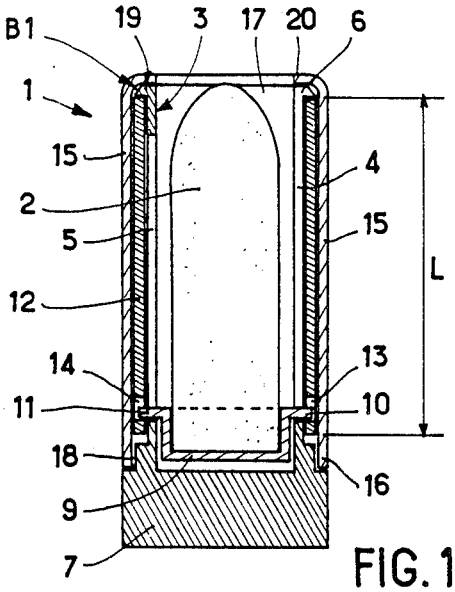

Referring to the drawings and to FIG. 1 in particular, a device 1 can be seen for applying a pasty product, lipstick in particular, presented in the form of stick 2.

Figure 2:
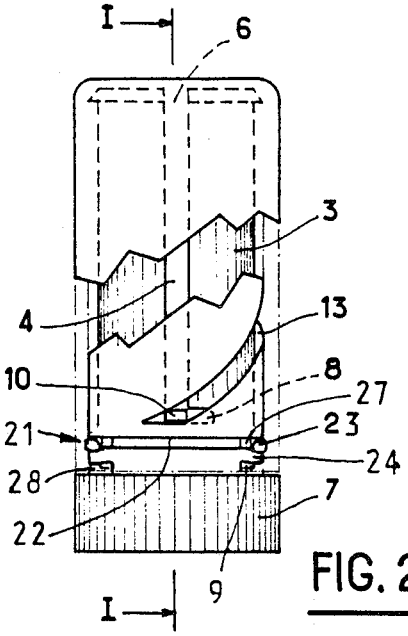
FIG. 2 is a view of the device from the right, in relation to FIG. 1 with stripped portions.

This device 1 comprises a tubular element 3 wherein provision is made for two diametrically opposed slides 4, 5 formed by slots passing through the wall of the element 3. The upper end 6 of slide 4 is open, as can be seen in FIGS. 1 and 2, on the other hand, the slide 5 is closed at its upper end.

The two slides 4 and 5 are closed at their lower end situated on the side of a knob 7, forming the base of the tubular element 3 and being fixed to the latter.

The slides 4 and 5 are rectilinear and bordered by two generatrices of the tubular element 3 which is cylindrical. The slide 4 comprises, at its lower end, a cut out 8 in the peripheral direction. Provision can be made for a similar cut out at the lower end and the upper end of the slide 5 for an end of travel lock.

A cup 9 (FIG. 1) is mounted to slide in the tubular element 3; this cup comprises two diametrically opposed stubs 10, 11 engaged respectively in the slides 4 and 5. The stubs 10 and 11 project radially towards the outside for a sufficient distance to pass completely through the slides 4 and 5 and to project from the external surface of the element 3.

A cylindrical shell 12 is fitted on the tubular element 3 and is retained on the latter by stop means B1, B2 at its two axial ends.

The shell 12 comprises in its wall, at least one and preferably two helical, diametrically opposed grooves 13, 14. These grooves 13, 14 can be formed by slots passing through the wall of the shell 12, these slots being closed at their ends. The stubs 10 and 11 are engaged by their external radial ends in the grooves 13, 14.

The tubular element 3, the cup 9 and the shell 12 are generally made of a plastic material. The shell 12 is secured, in particular by being force fitted or by bonding in an external casing 15, in particular a metallic one whose end 16 on the opposite side to the outlet opening 17 of the tubular element 3 is accommodated in an annular recess 18 arranged in the knob 7. The element 3 and the knob 7 are mounted for free rotation in relation to the shell 12 and the casing 15.

It will immediately appear that by acting on knob 7, so as to turn it as well as the element 3, in relation to the shell 12 and to the casing 15, one produces an axial ascending or descending motion of the cup 9 and of the stick 2, according to the direction of rotation because of the cooperation of the stubs 10, 11 with the helical grooves 13, 14.

The stops B1, B2 are provided on the tubular element 3.

The stop B1 is formed by a flange 19 projecting radially towards the outside surrounding the outlet opening 17 of the tubular element 3. The edge 20 of the casing 15 is folded over this flange 6 and defines a passage opening with the same diameter as that of the opening 17.

The shell 12, with a closed circular contour has an internal diameter which is substantially equal to the external diameter of the element 3 below flange 19; the external diameter of the shell 12 slightly exceeds that of the flange 19.

The diameter of the knob 7 exceeds the external diameter of the shell 12 and is approximately equal to the external diameter of the casing 15.

The shell 12 is mounted on the tubular element 3 by catch or snap engagement. For this purpose, as has been schematically illustrated in FIG. 3, the shell 12 is fitted on the end of the tubular element 3 provided with the flange 19.

Because of the presence of the open upper end 6 of the slide 4 in this flange 19, the tubular element 3 can be deformed and the diameter of the flange 19 can be reduced so as to penetrate into the shell 12. When this shell 12 has been sufficiently driven in, the flange 19 emerges from this shell and reassumes its original dimensions; the adjoining axial end of the shell 12 then abuts against the said flange 19 constituting the stop B1.

The stop means B2 provided on the element 3 towards its end remote from the outlet opening 17 are constituted by elastic stop means 21 capable of bearing on the adjoining edge 22 of the cylindrical shell 12 when the latter has been fitted on the element 3, the above mentioned elastic stop means 21 pushing the said shell 12 against the flange 19.

Figure 3:
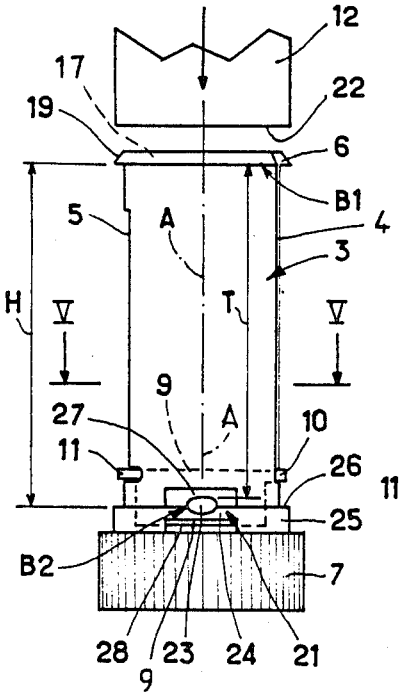
FIG. 3 is an elevational view illustrating the positioning of the cylindrical shell, which is partly represented, on the tubular element.

Each elastic stop means 21 comprises a boss 23 projecting radially towards the outside provided on a flexible strip 24 of the wall of the tubular element 3. The flexible strip 24 is orientated transversely in relation to the direction of axis A—A of the tubular element 3. Preferably, this flexible strip is orientated along the circumferential direction, orthogonally to this A—A axis as shown in FIG. 3.

Figure 4:
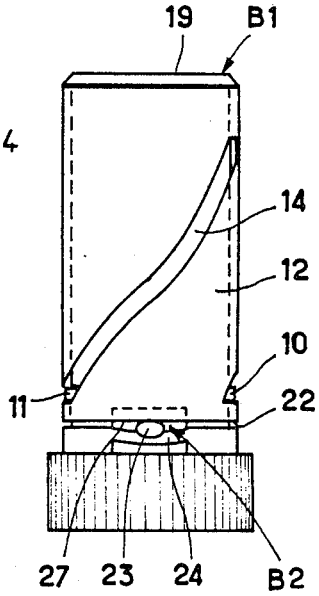
FIG. 4 is an elevational view of the tubular element whereon the cylindrical shell has been fitted.

The tubular element 3 can comprise, in front of the knob 7, a zone 25 with a larger diameter forming a shoulder 26 at the level of the transition to the major portion or the tubular element 3; the external diameter of the zone 25 is substantially equal to the external diameter of the shell 12. Provision can be made for the flexible strip 24 to adjoin the shoulder 26 in the zone 25 as shown in FIGS. 3 and 4. The boss 23 projects along a direction parallel to the A—A axis in relation to the shoulder 26 towards the flange 19. The distance along the axial direction between the shoulder 26 and the flange 19 has been designated by H. The axial length of the shell 12 has been designated by L.

The flexible strip 24 is delimited by two transverse holes 27, 28 provided transversely on either side of the said strip 24. Thus this strip is formed by a kind of tongue of the wall of element 3 which remains between the two holes 27, 28 cut into this wall. The angular extent E of the strip 24 appears in FIG. 5. It can be of the order of 15°. The boss 23 is situated on the edge of the strip 24 turned towards the flange 19.

Figure 5:
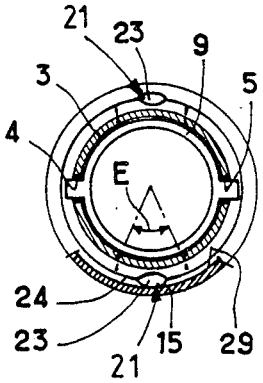
FIG. 5 is a cross section along line V—V of FIG. 3.

Advantageously, the elastic stop means 21 are provided at two diametrically opposed points of the tubular element 13 as may be seen in FIG. 5, each elastic stop means 21 being arranged as previously described.

Preferably, these elastic stop means 21 are situated along the circumference at right angles in relation to the slides 4, 5 as may also be seen in FIG. 5 in order to facilitate demoulding. As a variant, the stop means 21 can be provided in the axis of the slides.

Each boss 23 has a sufficient radial dimension to rub against the internal surface 29 (FIG. 5) of the casing 15. It should be noted that the flexible strip 24 is also elastic along the radial direction, this elasticity allowing the boss 23 to bear constantly against the internal surface 29.

The distance along the direction parallel to the A—A axis between the flange 19 and the edge of boss 23 turned towards this flange has been designated by T. (FIG. 3)

To be certain that the shell 12, after being fitted on the tubular element 3 should bear axially at its two ends respectively against the flange 19 and against the bosses 23, the distance T is chosen to be smaller than the minimum distance L which the shell 12 can assume because of dimensional production variations.

In these circumstances, when the shell 12 is being fitted on the tubular element 3, it will be necessary to exert an axial thrust via the edge 22 against the bosses 23 so as to deform the flexible strip 24 as schematically outlined in FIG. 4, to allow the other axial end of the shell 12 to cross the flange 19. The deformation of the flexible strip 24 will be more, or less extensive according to the value, which is variable within the production tolerances, of length L of the shell 12. But irrespective of this length L within the range of the production tolerance, one is certain that the bosses 23 will absorb the dimensional variations and will maintain the shell 12 in bearing contact against the flange 19.

Similar observations will apply to the cooperation of the bosses 23 and of the internal surface 29 of the casing 15. The elasticity of the flexible strip 24 along the radial dimension makes it possible to absorb the dimensional variations of the internal diameter of the casing 15 and of the external diameter of the element 3.

The elasticity of the flexible strip 24 both in the axial direction and in the radial direction establishes a contact force between the various surfaces which is substantially constant.

A simultaneous contact of the two axial ends of the shell 12 with the stops provided on the element 3 could not have been ensured in all cases if the stop B2 had been fixed as the stop B1 and had been constituted, for instance, by the radial shoulder 26. Because of the dimensional variations in the course of production, the equality between the length L and distance H could not be ensured.

Because of the dimensional variations in such a case where B2 would be fixed, it would be necessary to make provision for a minimum clearance of 0.2 to 0.3 mm to be certain of being able to fit the shell 2 on the tubular element 3 by snap engagement. There would result therefrom a relatively loose mounting of the tubular element 3 within the shell 12 with the possibility of slight axial movements of the element 3 in relation to the shell 12 and the casing 15 and a less precise and less agreeable control of the displacements of the stick 2.

Figure 6:
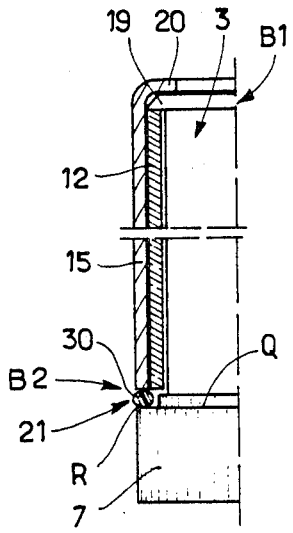
FIGS. 6 to 10 represent variants of the embodiment in partial axis half cross sections.

Referring to the FIG. 6 and the following ones, various illustrations may be seen of another possibility of making the elastic means 21 which are then constituted by an elastic ring R surrounding the tubular element 3; the ring R is disposed between a shoulder Q of the tubular element 3 and the cylindrical shell 12 and/or casing 15.

The shoulder Q is situated at the level of the transition zone between the knob 7 and the portion of the tubular element 3 situated in front of this zone, that is to say, above this zone according to the illustration of FIGS. 6 to 18.

According to a variant of FIG. 6, the elastic ring R is constituted by an O ring disposed between the shoulder Q and the transverse end surface of the casing 15. The axial thrust exerted by the ring 30 on the casing 15 is transmitted to the shell 12 which is fixed to this casing 15. The ring 30 therefore pushes the shell 12 against the flange to see previously explained, although the said ring 30 is not in direct contact with the shell 12.

Advantageously, the shoulder Q is arranged in such a way that this bearing Q would have the effect of limiting the crushing of the ring 30 when it is force fitted in the transition zone between the knob 7 and the cylindrical shell 12 and/or the casing 15.

Figure 11:
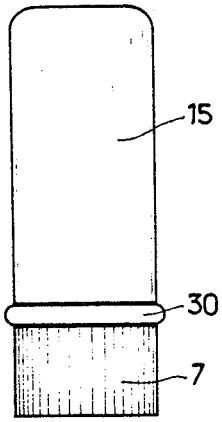
FIG. 11 is an elevational view of a device in accordance with FIG. 6.

FIG. 11 shows the external appearance of the device of FIG. 6, the ring 13 appearing between the knob 7 and the casing 15.

Figure 7:
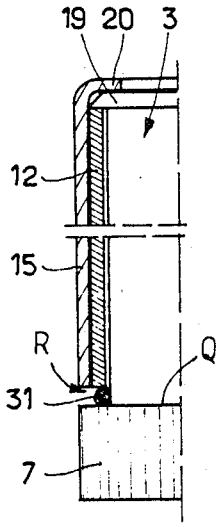
Figure 9:
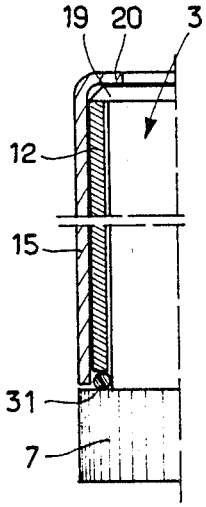

FIG. 7 shows a variant according to which the elastic means 21 are constituted by an O ring 31 which come to grip the body of the tubular element 3. This O ring is gripped axially between the shoulder Q and the transverse end surface of the shell 12. According to the variant of FIG. 7, the ring 31 is directly exerting its thrust on the shell 12 which is thus kept in bearing contact at its other end against the flange 19. If required, the casing 15 can axially cover the ring 31 and the latter can come to rub on the outside in the radial direction against the internal surface of the casing 15 as shown in FIG. 9.

Figure 8:
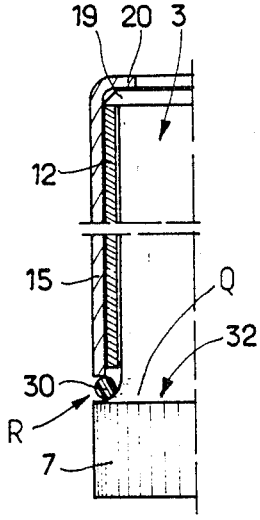

FIG. 8 illustrates a variant of FIG. 6, according to which, the shoulder Q has a shoulder surface 32 inclined radially towards the outside; this surface 32 of revolution admits an arc-shaped meridian line turning its concavity towards the outside, the diameter of the surface 32 increasing progressively towards the knob 7, the O ring 30 is gripped axially between this surface 32 and the casing 15.

Figure 10:
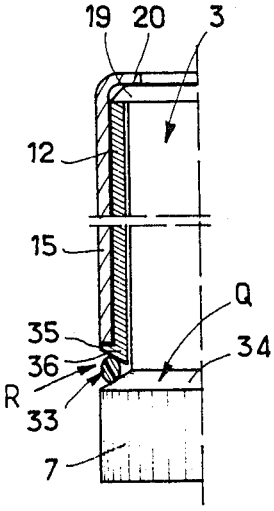

The FIG. 10 illustrates a variant wherein the elastic means 21 are formed by an elastic ring 33 of revolution with a circular or elliptical cross section gripped axially against the shoulder Q which has a shoulder surface 34 inclined radially towards the outside. This surface 34 is frustonconical or slightly convex towards the outside and increases in diameter towards the knob 7. The shell 12 has an edge 35 also having a frustonconical surface 36 orientated in the opposite direction of surface 34; the ring 33 is gripped axially between the two surfaces 34 and 36 which converge towards each other. The casing 15 can come to bear against the external radial shoulder formed by the projection of the edge 35.

Figure 12:
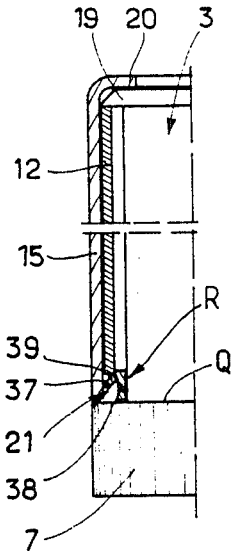
FIGS. 12 and 13 represent variants of the embodiment in partial axial half cross sections.
Figure 13:
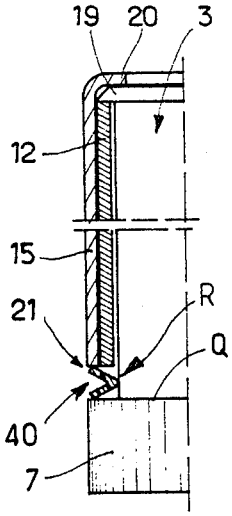

The FIGS. 12 and 13 show variants of the embodiment wherein the elastic means 21 are constituted by elastic rings having a transverse cross section in the shape of a dihedron.

According to FIG. 12, the elastic ring 37 comprises a cylindrical portion 38 surrounding the portion of the tubular element 3 situated beyond the knob 7, the said portion 38 bearing axially against the shoulder Q. This cylindrical portion 38 is integral at its remote end from the shoulder Q with a lip 39 of a substantially frustonconical shape directed towards the shoulder Q and increasing progressively in diameter towards this shoulder. The front end surface of the shell 12 bears axially against the external surface of the lip 39. The casing 15 can come to cover this lip 39 which can then bear radially towards the outside against the internal surface of the casing 15; the elastic lip 39 pushes the shell 12 back axially against the flange 19.

FIG. 13 shows a variant of the embodiment wherein the elastic means 21 are formed by an elastic ring 40 of revolution with a V shaped cross section, the tip of the V being turned towards or bearing on the portion of the tubular element 3 which extends the knob 7. One arm of the V bears against the shoulder Q whilst the other arm of the V bears axially against the front end of the casing 15. The flexural elasticity of the ring 40 ensures the axial thrust on the casing 15 which thrust is transmitted to the shell 12 fixed to the casing 15. As in the case of the FIGS. 6 and 8, it may be considered that according to FIG. 13, the elastic means 21 bear indirectly on the shell 12.

Figure 15:
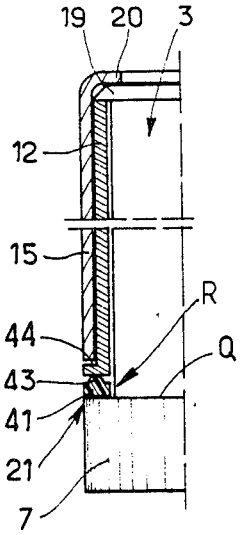
Figure 14:
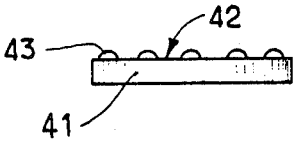
FIG. 14 is an elevational view of the elastic ring of the variant of FIG. 15.

In accordance with the embodiments of FIGS. 14 and 15 the elastic means 21 are formed by an elastic ring 41 with a rectangular transverse cross section bearing against shoulder Q. The surface 42 turned towards the shell and/or the casing 15 is provided with bosses 43 of a substantially hemispherical shape regularly distributed over the periphery of the surface 42. The shell 12 is provided at its end turned towards the knob 7 with a flange 44 projecting radially towards the outside; the transverse side of the flange 44 turned towards the knob 7 comes to bear against the bosses 43 which allow contact to be established over a limited surface reducing friction.

Figure 16:
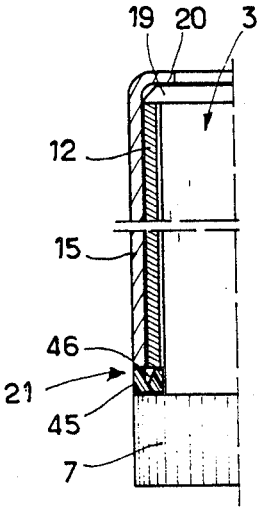

According to the embodiment of FIG. 16, the elastic means 21 are formed by an elastic ring 45 of revolution whose transverse cross section is substantially set in a square. This transverse cross section has a V shaped cut out 46 on the side turned towards the shell 12 and the casing 15. Two lips are thus defined on either side of this cut out 46; the shell 12 comes to bear axially against the lip situated radially inside whilst the casing 15 comes to bear axially against the other lip.

Figure 17:
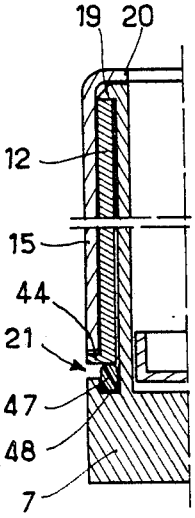

According to FIG. 17, the elastic means 21 are formed by an elastic ringe 47 with a substantially rectangular cross section, the large dimension of this transverse cross section being parallel to the axis of the device. This ring 47 is partly engaged in an annular recess 48. The portion of the ring 47 which projects axially out of the recess 48 bears against the axial end of the shell 12 provided with a flange 44 which is identical with that provided in FIG. 15.

Figure 18:
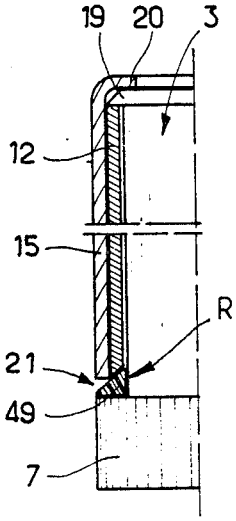

According to the variant of FIG. 18, the elastic means 21 are formed by an elastic ring 49 of revolution with a triangular cross section, the hypoteneuse of which triangle is turned towards the shell 12 and the casing 15. The base of the shell 12, possibly chamfer shaped to conform to the cross section of the ring 49, comes to bear axially against this ring. The shell 12 is thus pushed back against the flange 19.

In a more general way, the ring R could have a substantially polygonal transverse cross section.

Irrespective of the variant of the embodiment of FIGS. 6 to 18, the operation of the mechanism is rendered "smooth" by absorbing the interference noises and restraint of the tubular element 3 relative to the shell 12 and/or the casing 15, thanks to the elastic ring provided between, on the one hand, the tubular element 3 and its knob 7 and, on the other hand, the shell 12 and/or the casing 15. This elastic ring 30, 31, 33, 37, 40, 41, 45, 47, 49 tautens all the components after snap engagement of the flange 19.

As has been described above, the elastic ring can have various profiles and be moulded either of elastomers, nitrile, silicone etc. . . . ) or of thermoplastic materials such as polyurethane, polyvinyl chloride or other appropriate plastic materials.

The elastic ring can be moulded on the shoulder Q or at the base of the shell 12 and/or the casing 15.

It should be noted that when the elastic means 21 are fixed by moulding, or other means on to one of the components, these elastic means 21 may no longer be constituted by an elastic ring completely surrounding the tubular element but by sectors of an elastic material independent of each other, provided at various zones of the periphery.

In the variants of FIGS. 10, 15 and 17 where the shell 12 is provided at its end turned towards the knob 7 with an edge covering the end of the casing 15, one reduces the risk of shearing the elastic ring by the casing 15 which is generally made of metal.

The ring or elastic component constituting the elastic means 21 can have a solid or hollow cross section; in certain cases, it can turn back to the outside on to the casing 15 to keep it secure.

The device in accordance with the invention makes is possible to ensure a securing effect and take-up of the play and thus to improve the actuation.

It should be noted that the invention applies entirely in the case where the shell 12 and the casing 15 form one and the same component.

The functioning of the device is also improved and a smoother manipulation of knob 7 is obtained.

An automatic assembly of the device can be obtained without difficulty because one is sure that the shell 12 can be mounted on to the tubular element 3 by snap engagement.

Preferably, the tubular element 3 is made of a polymeric material, in particular of a semi-rigid material having a low coefficient of friction.

The elimination of extremely close tolerances of the various components of the mechanism, in accordance with the invention, facilitates the moulding and stamping operations. In certain variants of the embodiment, in particular those of FIGS. 6 and 11, the elastic means 21, formed by a ring projecting radially towards the outside on to the casing 15 allow a good seal to be obtained when this device is provided with a cap, which can be worthwhile when the pasty product contains a volatile substance.

The adjustment of the firmness or smoothness of operation will be effected by acting on the following parameters;

the pliability of the elastic means;
the coefficient of friction of the elastic means;
the surface in contact with these elastic means;
a hollow profile or not of these elastic means;
the rate of compression of the elastic means, in particular in the case of the elastic rings
the grip on the internal diameter of the elastic rings.

I claim:

1. A device for applying a pasty product, in particular a cosmetic product such as lipstick, presented in stick form, comprising: a tubular element with a slide wherein there is slidably mounted a cup intended to accommodate the stick of the product and comprising at least one stub of said cup engaged in the slide; a cylindrical shell having a wall having at least one helical groove, said shell being fitted on the tubular element and being retained on the latter by stop means at its two axial ends, the stub of the cup being engaged in the helical groove of the shell and an external, metallic casing, wherein the shell is secured whilst the tubular element can turn in relation to the said shell and casing, the device being such that when the tubular element is caused to turn in relation to the shell, the cooperation of the stub of the cup with the groove produces an axial movement of the cup and the movement of the stick of the product according to the direction of rotation via an outlet opening of the tubular element, wherein the tubular element with the slide has an external wall which is provided towards the end remote from the outlet opening with elastic stop means capable of bearing on the adjoining edge of the cylindrical shell when the latter has been fitted on the tubular element, and another stop means at the end adjacent said outlet opening, the said elastic stop means remote from said outlet opening pushing the said shell continuously along the direction parallel to the axial direction against the said another stop means provided at the end adjacent said outlet opening, said elastic stop means comprising a boss projecting radially towards the outside, said tubular element having a flexible strip and said boss engaging said flexible strip of said tubular element, said flexible strip being oriented transversely in relation to the axis of said tubular element, said flexible strip being defined by two transverse holds formed in said tubular element on either side of said flexible strip.

2. A device according to claim 1, characterised in that the flexible strip is constituted by a portion of the wall of the tubular element generally made of a plastic material.

3. A device according to claim 1, characterised in that the elastic stop means are provided at two diametrically opposed points of the tubular element.

4. A device according to claim 1, characterised in that the elastic stop means are situated along the circumference at right angles in relation to two diametrically opposed sides of the tubular element.

5. A device according to claim 1, characterized in that the tubular element comprises a knob at the end remote from said outlet opening and a zone with a larger diameter in front of said knob at the end of the tubular element remote from said outlet opening; said tubular element having an axis, said flexible strip being provided in said zone adjoining said shoulder and said boss projecting along a direction parallel to said axis of said tubular element in relation to said shoulder.

6. A device as claimed in claim 1, characterized in that said tubular element has an axis and said flexible strip is oriented along the circumferential direction orthogonally to said axis.

7. A device according to claim 1, characterised in that the elastic strip means comprise an elastic component disposed on the one hand between a shoulder of the tubular element and, on the other hand, the cylindrical shell and/or the casing.

8. A device according to claim 7, characterised in that the elastic component is formed by an elastic ring surrounding the tubular element.

9. A device according to claim 8, characterised in that the elastic ring is formed by an O ring.

10. A device according to claim 8, characterised in that the elastic ring has a dihedral shaped cross section and has at least one pliable peripheral lip.

11. A device according to claim 8, characterised in that the elastic ring has a substantially polygonal transverse cross section.

12. A device according to claim 8, characterised in that the surface of the ring turned towards the shell is provided with bosses allowing the surface of friction to be limited.

13. A device according to claim 8, characterised in that the elastic ring is moulded.

14. A device according to claim 1, characterised in that the elastic stop means have a sufficiently large radial dimension to rub against the inner surface of the casing and to serve as a lateral restraint.

15. The device as claimed in claim 8, wherein the said tubular element includes a shoulder surface that is inclined radially outwardly and said ring bears against said shoulder surface.

* * * * *